US009930949B2

(12) United States Patent
Zoland

(10) Patent No.: US 9,930,949 B2
(45) **Date of Patent: *Apr. 3, 2018**

(54) BAG EXPANDERS

(71) Applicant: Martin Zoland, South Melbourne (AU)

(72) Inventor: Martin Zoland, South Melbourne (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/075,405

(22) Filed: Mar. 21, 2016

(65) Prior Publication Data

US 2016/0331095 A1 Nov. 17, 2016

Related U.S. Application Data

(60) Provisional application No. 62/161,189, filed on May 13, 2015.

(51) Int. Cl.
*B65D 30/00* (2006.01)
*A45C 13/00* (2006.01)

(52) U.S. Cl.
CPC ..... *A45C 13/004* (2013.01)

(58) Field of Classification Search
CPC ..... A45C 13/004
USPC ..... 383/127
See application file for complete search history.

(56) References Cited

U.S. PATENT DOCUMENTS 2,019,636 A * 11/1935 Scrantom ..... B60R 9/065 190/107
2,798,579 A * 7/1957 Fox ..... A45C 7/0077 190/107
4,077,451 A * 3/1978 Zoland ..... A45C 13/004 140/106
4,141,399 A * 2/1979 Zoland ..... A45C 13/004 190/106
4,142,564 A * 3/1979 Zoland ..... A45C 13/004 190/106
4,599,832 A * 7/1986 Benton ..... E04H 12/185 5/99.1
4,946,292 A * 8/1990 Diamond ..... A45C 13/004 190/106
4,969,751 A * 11/1990 Diamond ..... A45C 13/004 190/106
4,993,846 A * 2/1991 Diamond ..... A45C 13/004 190/106
5,030,014 A * 7/1991 Diamond ..... A45C 13/004 190/106
5,179,600 A * 1/1993 Bailey ..... A45C 13/004 150/900
5,259,674 A * 11/1993 Hedaya ..... B65D 33/007 383/127
5,292,197 A * 3/1994 Reisman ..... A45C 13/004 383/127
5,322,362 A * 6/1994 Smith ..... A45C 13/004 383/127

(Continued)

*Primary Examiner* — Jes F Pascua
(74) *Attorney, Agent, or Firm* — Lewis B. Sternfels

(57) ABSTRACT

The expander includes side walls positionable against a bag interior, members articularly connected together and to the side walls, and an arcuate enabling diamond shaped mechanism connected between the members and the side walls to provide a selected expanding and contracting amongst the members and the side walls. The members are in a folded condition when the bag is compressed and, with the aid of an expansion motivator such as a rubber band, spring and the like, the bag is expanded to its deployed condition.

15 Claims, 14 Drawing Sheets

(56) References Cited

U.S. PATENT DOCUMENTS

| | | | | | |
|---|---|---|---|---|---|
| 5,350,241 | A * | 9/1994 | Zoland | A45C 13/004 | 383/127 |
| 5,400,906 | A * | 3/1995 | Tang | A45C 13/004 | 206/457 |
| 5,499,874 | A * | 3/1996 | Tang | A45C 13/004 | 383/127 |
| 5,542,767 | A * | 8/1996 | Hedaya | A45C 13/004 | 383/127 |
| 5,758,974 | A * | 6/1998 | Markowitz | A45C 13/004 | 383/127 |
| 6,022,146 | A * | 2/2000 | Bull | A45C 13/004 | 383/127 |
| 6,102,570 | A * | 8/2000 | Bull | A45C 13/004 | 383/127 |
| 6,213,643 | B1 * | 4/2001 | Lin | A45C 13/004 | 229/122.23 |
| 6,550,967 | B2 * | 4/2003 | Hedaya | B65D 33/02 | 383/127 |
| 6,698,927 | B2 * | 3/2004 | Hedaya | B65D 33/00 | 383/127 |
| 7,699,149 | B2 * | 4/2010 | Lin | A45C 7/0022 | 190/103 |
| 2006/0233472 | A1 * | 10/2006 | Encarnacion | A45C 13/02 | 383/127 |
| 2008/0137999 | A1 * | 6/2008 | Chi | A45C 7/0063 | 383/127 |
| 2016/0331094 | A1 * | 11/2016 | Zoland | A45C 13/004 | |

* cited by examiner

FIG. 16
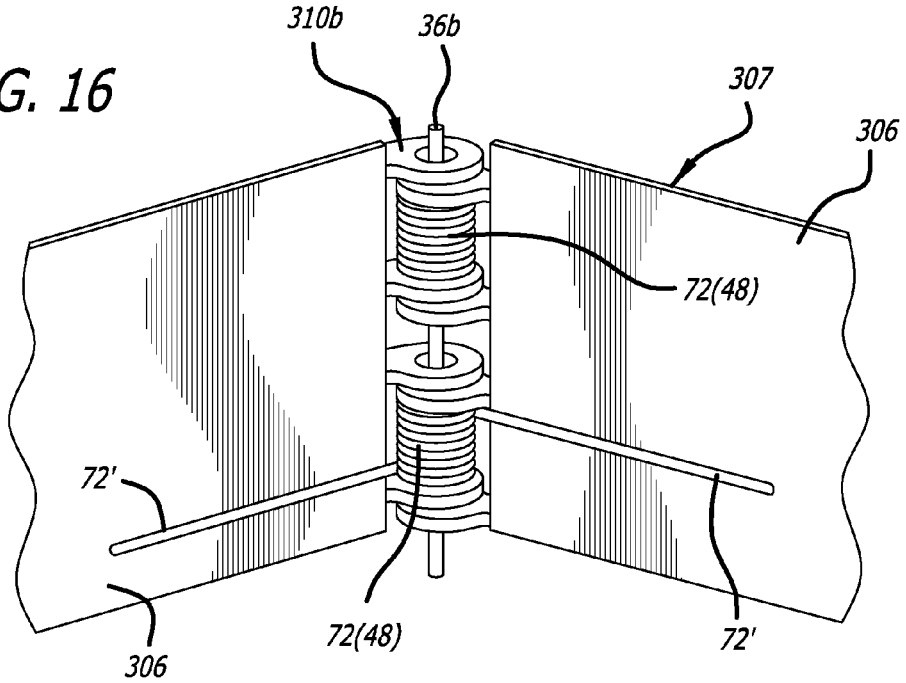
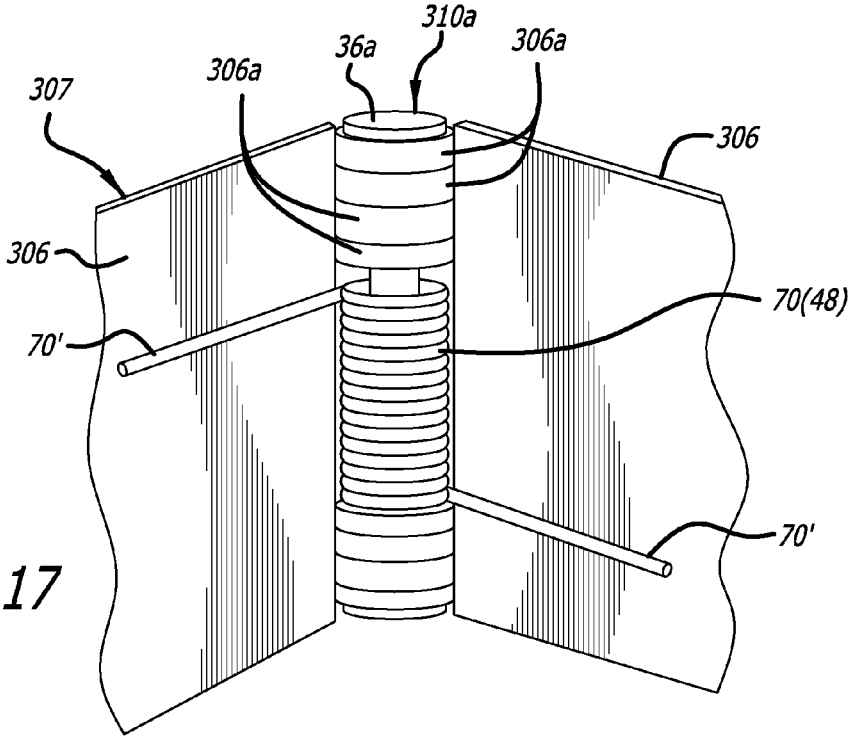
FIG. 17

BAG EXPANDERS

CROSS-REFERENCE TO RELATED APPLICATION

This application claims the benefit of U.S. Provisional Application No. 62/161,189 filed 13 May 2015 entitled "Bag Expander."

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

The present invention relates an apparatus and method for permitting the shipment of flexible sided bags such as cosmetic bags, purses, soft-sided luggage and handbags in a flattened condition with implementation provided within the bag by which the bag may be expanded to present an attractive appearance at the point of sale.

2. Description of Related Art and Other Considerations

In shipping of merchandise, freight payments are made, not only with respect to weight, but also with respect to volume. Commercial transport of goods is normally charged by volume as well as by weight of the goods, and articles, such as bags, which can be collapsed for transport thereby providing a distributor with significant cost savings. The disadvantage of such collapsible goods, however, is that on reaching their destination they invariably need to be expanded so as to present an attractive appearance and thereby enhance sale prospects. Purchasers of collapsible goods normally spend an inordinate amount of time filling the goods with costly inserts and foam material so the goods can be presented in an expanded form. In addition to display, when the insert is used like a shoe tree, e.g., for an expensive handbag or the like, an expander expands the bag to help the bag retain its shape.

A number of devices have been proposed in the past as attempts to alleviate the above problems but most have proved ineffective, relatively cumbersome and/or expensive to implement. By providing a device which may be inserted in the bag at the point of manufacture and which may be expanded at the point of display, the bag may be shipped flat and erected for a suitable attractive appearance at the point of sale.

SUMMARY OF THE INVENTION

These and other problems are successfully addressed and overcome by the present invention. The expander includes side walls which are positionable against the bag interior, members articularly connected together and to the side walls, an arcuate enabling diamond shaped mechanism connected between the members and the side walls to provide a selected expanding and contracting amongst the members themselves and the side walls. The members are in a folded condition when the bag is compressed and, with the aid of an expansion motivator such as a rubber band, spring and the like, the bag is expanded to its deployed condition.

Several objects and advantages are derived from this arrangement, such as to provide an effective and inexpensive expanding device for collapsible articles.

Other aims and advantages, as well as a more complete understanding of the present invention, will appear from the following explanation of exemplary embodiments and the accompanying drawings thereof.

BRIEF DESCRIPTION OF THE DRAWINGS

FIG. 16 is an isometric presentation of a second expansion motivator, configured as a single spring, useful particularly in the embodiments illustrated in FIGS. 1-9, rather than a rubber band as shown therein.

FIG. 17 is an isometric presentation of a second expansion motivator, configured as a double spring, useful particularly also in the embodiment illustrated in FIGS. 1-9, rather than a rubber band as shown therein.

DETAILED DESCRIPTION OF THE PREFERRED EMBODIMENTS

Figure 7:
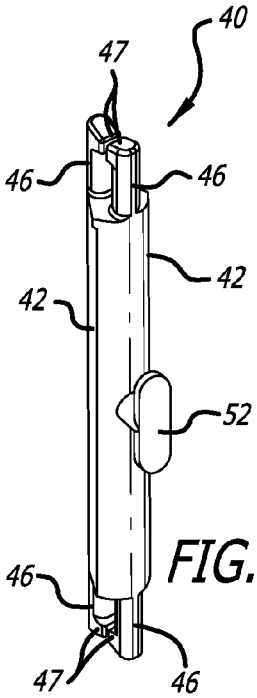
FIG. 7 is an isometric presentation of an axle pin used in the first and subsequent embodiments of the bag expander.
Figure 8:
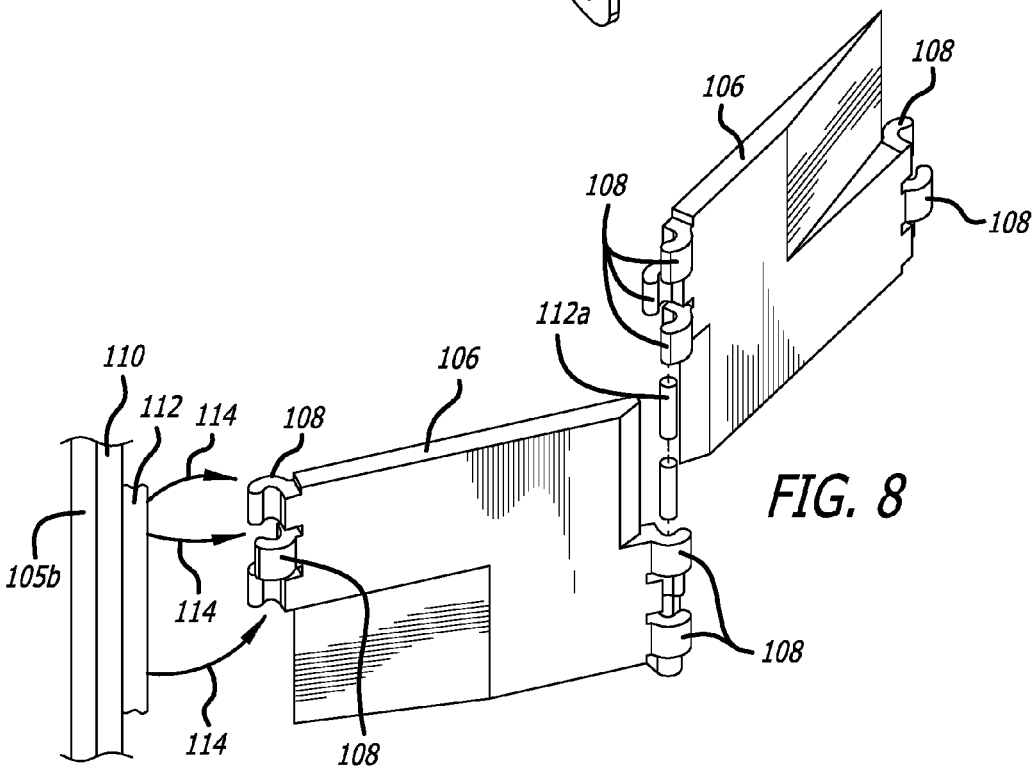
FIG. 8 is an isometric presentation of two adjacent ones of the four members used in the first embodiment of the bag expander and a portion of a side wall illustrating the pivotal connection between a member and the side wall which pivotal connection comprises alternately-directed generally C-shaped closures engaging a rod-shaped bar on the side wall.

Accordingly, as depicted in FIGS. 1-8, a bag expander 100 is shown as contained or otherwise positioned within a receptacle or bag 20, which is depicted in phantom or dashed lines. Bag 20, as modeled from U.S. Pat. No. 5,350,241 (which is referenced herein as if stated in haec verba), includes a zipper 22, a zipper closed end 24, a zipper tab 26 at the other or openable end (as opposed to end 24) and a gusset or gusset area 28. The bag expander includes a pair of side walls 104 coupled together by four connecting members 106 which are arranged as a connecting member assembly 107 in a diamond configuration. Such a configuration may be considered as providing an articulate connection or, if more than one connection, articulate connections, and a joint or joints. Side walls 104 may comprise a frame 105*a* supported by links 105*b* as shown in the FIG. 1 embodiment (e.g., also see FIGS. 3, 5 and 6) or as the similar embodiments (204) in FIGS. 9-12 or solid pieces 404 as embodied in FIGS. 19 and 20. With respect to the first embodiment as best shown in FIG. 8 and in partial in FIG. 5, each connecting member terminates at its opposed ends with alternately-directed generally C-shaped closures 108. Closures 108 are adapted to engage axle pins 40 as best illustrated in FIG. 7. Axle pins 40 are positioned between mating members 106 and side walls 104 and, because of their more universal use, are adaptable to other embodiments as will be hereinafter described. The axle pins include a pair of parallely extending legs 42 which are appropriately joined together, e.g., by a plurality of spaced connecting pieces. Each leg 42 terminates in an end 46 for which a projection 47 projects. Ends 46 on spaced axle pins, as selectively used, provide spaced connecting points for expansion motivators 48, here embodied as rubber bands 50. Projections 47 prevent the rubber bands from slipping off from ends 46. The joints include the axle pins (e.g., indicium 40) which respectively join the members and which joints are spaced from one another. The axle pins have connecting points, and expansion motivators comprising spring devices are coupled to opposed ones of the axle pin connecting points.

For definition purposes, indicium 48 is used to generally denote an expansion motivator, however it may be composed as a specific component, here in several embodiments (FIGS. 1-15) as a rubber band 50. In further embodiments, viz., FIGS. 16-18, the specific expansion motivator (a spring) will be designated as "x(48)" where the letter "x" indicium will be later identified as a numeral indicium. Accordingly, when a specific expansion member is depicted in the drawings, its specific indicium will first be presented with the generally denoted expansion motivator in parenthesis, to wit, for a rubber band "50(48)" and for a spring "x(48)."

Returning again to the first embodiment and to bag expander 100, legs 42 have at least a partial circular cross-section so as to provide attaching pivots that enable C-shaped closures 108 to be pivotally connected to side walls 104, as will be presently described. Preferably centered on a leg 42 is a promontory 52, which is shaped as having one of a T-configuration or L-configuration, for example, and which is used as a connection component for coupling connecting members 106 to side walls 104.

Figure 1:
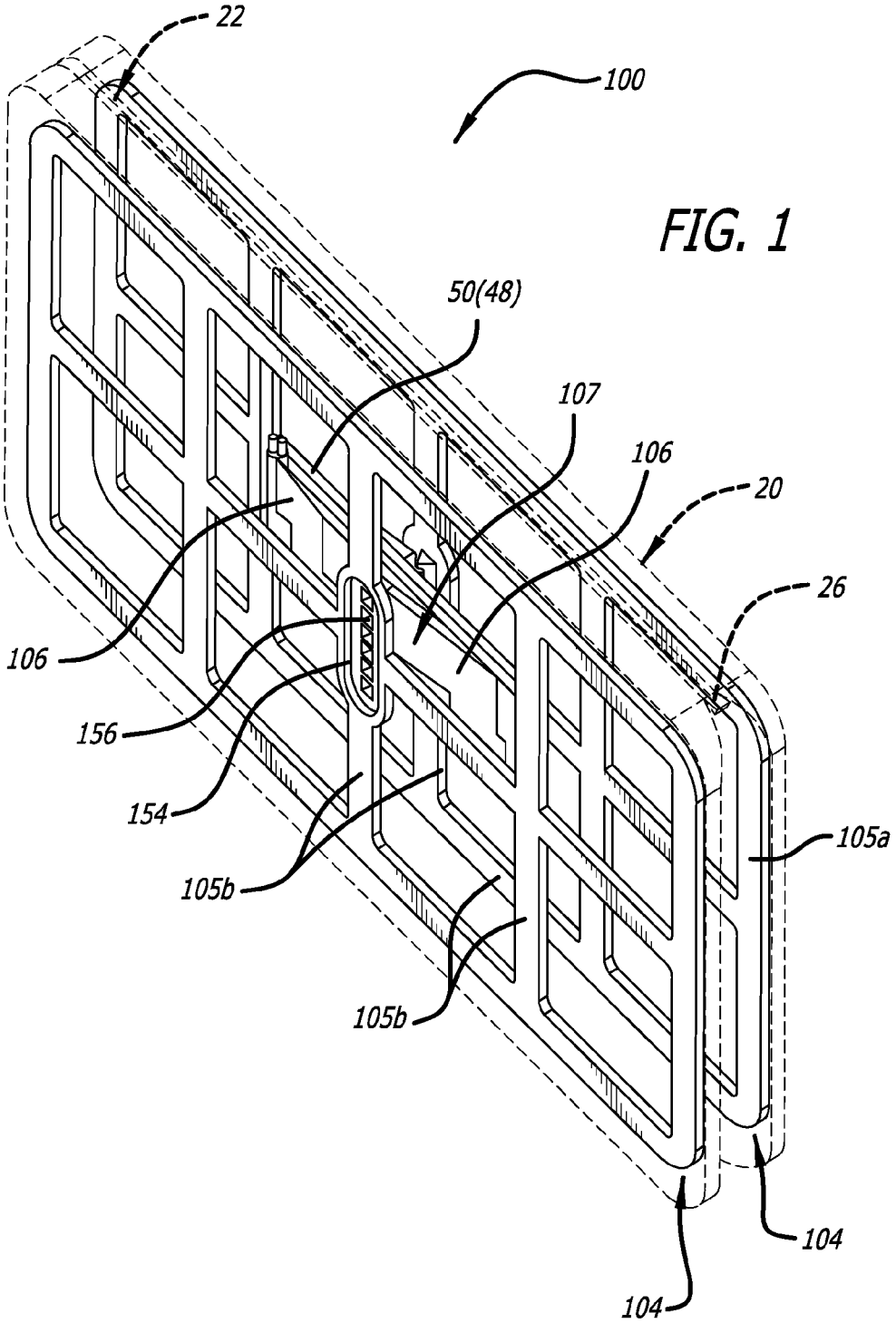
FIG. 1 is an isometric presentation of a first embodiment of the bag expander as compressed and contained in a receptacle or bag, which is depicted in phantom or dashed lines. The bag expander is illustrated as utilizing four pivotally connected connecting members configured as a diamond having a pivotal connection with parallely placed side walls. The side walls are movable away from one another by an expansion motivator. The expansion motivator is represented in this embodiment, as an example, as a rubber band. The indicia utilized hereinafter in the first embodiment range within a numerical 100 series.
Figure 2:
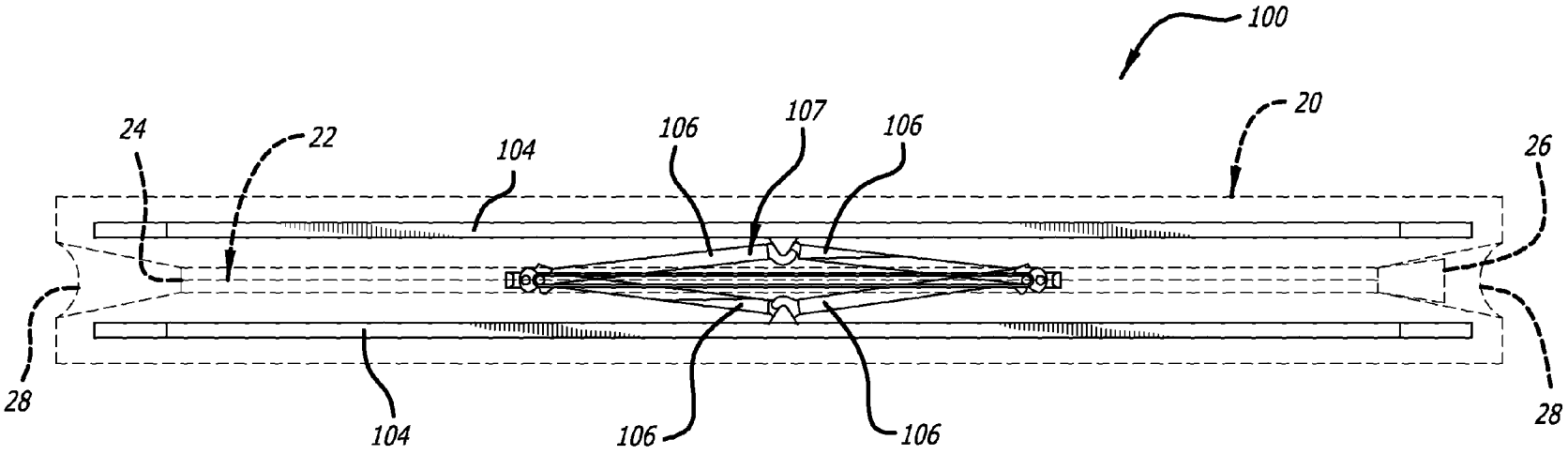
FIG. 2 is a top view of the first embodiment of FIG. 1 within the receptacle or bag, as fully compressed.
Figure 3:
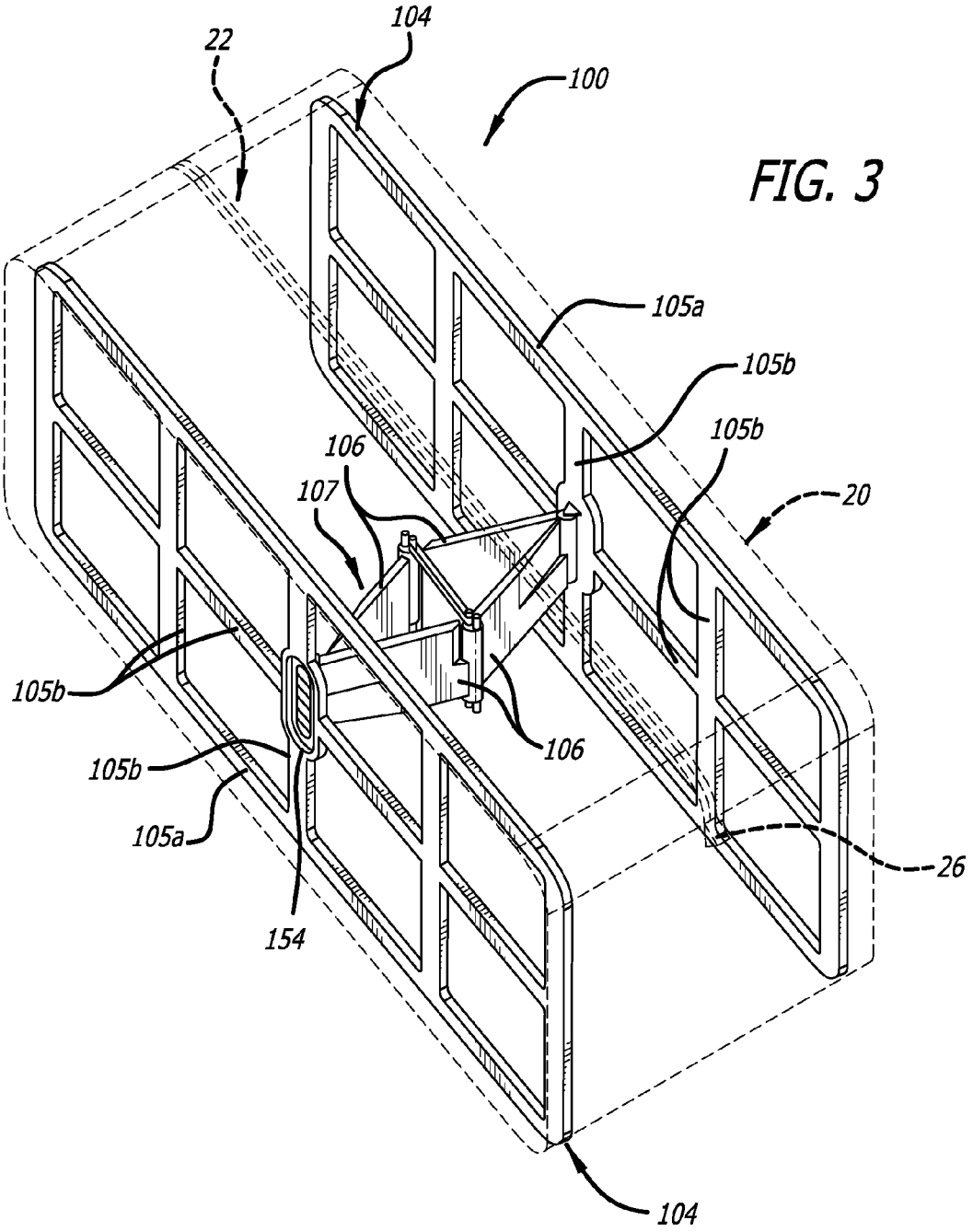
FIG. 3 is an isometric presentation of the first embodiment of FIG. 1 within the receptacle or bag, as fully expanded.
Figure 4:
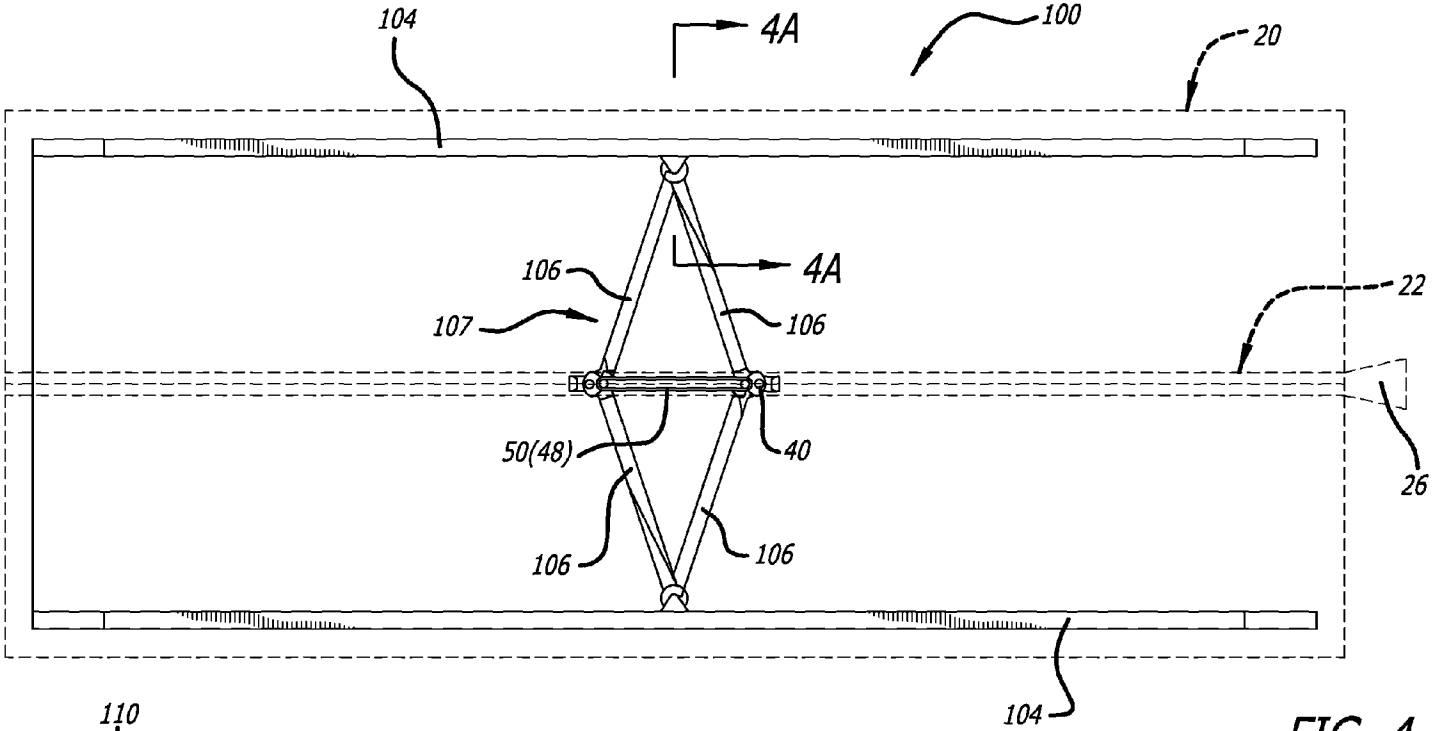
FIG. 4 is a top view of the first embodiment of FIG. 1 within the receptacle or bag, as fully expanded.
Figure 4A:
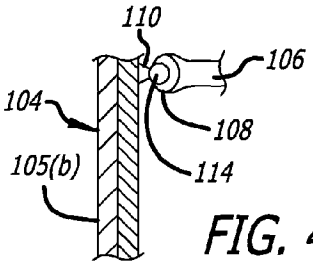
FIG. 4*a* is a cross-sectional view of the pivotal connection between a diamond-shaped members taken along cross-sectional 4A-4A shown in FIG. 4.
Figure 5:
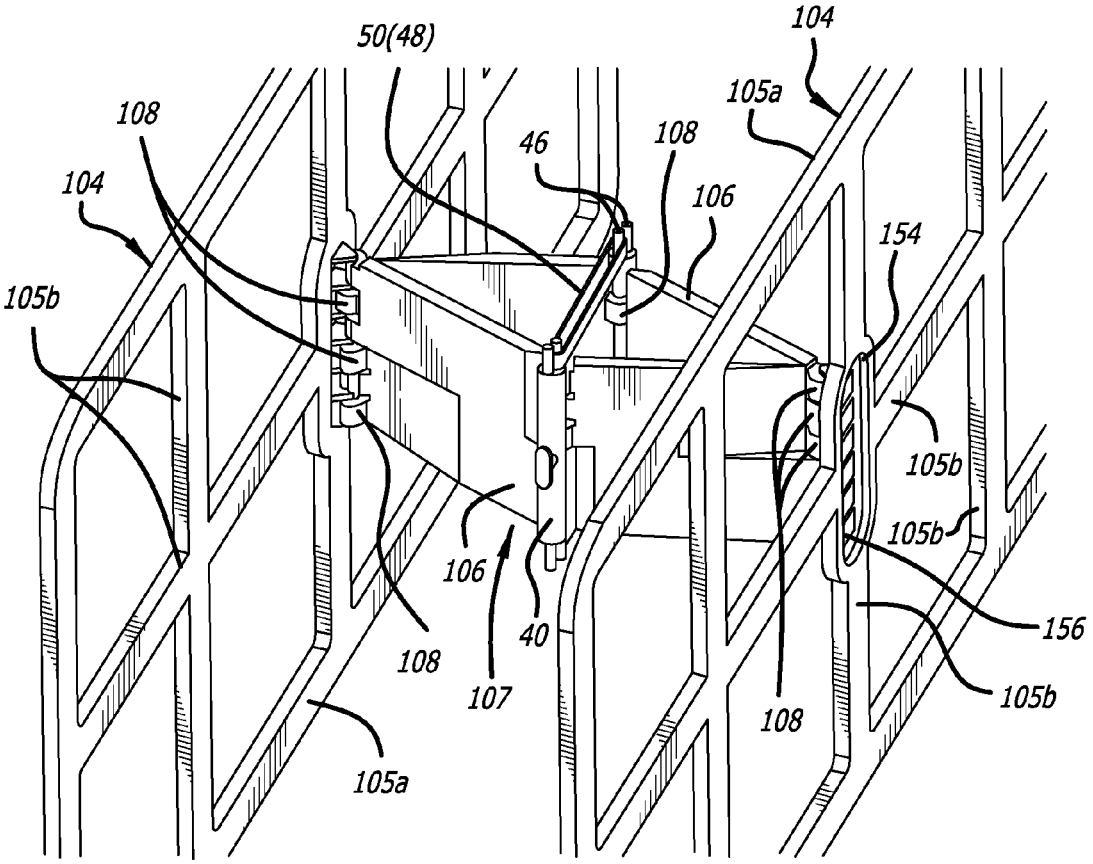
FIG. 5 is an isometric presentation in partial view of the first embodiment of the bag expander as expanded.
Figure 6:
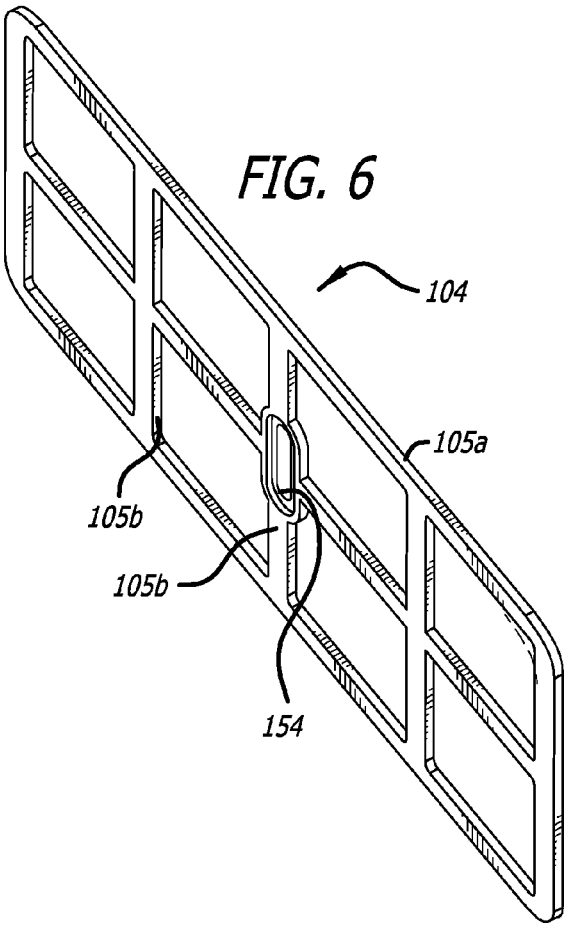
FIG. 6 is an isometric presentation view of a side wall used in the first and subsequent embodiments of the bag expander.

The pivotal coupling of selected connecting members 106 to side walls 104 is effected and completed by the providing of openings 154 (see FIGS. 3, 5 and 6) formed within links 105*b* of side walls 104, e.g., similarly as described hereinafter with respect to FIG. 10 and its entries 256 and connection points 258. A supporting part 110 (see FIGS. 4A and 8) has rod segments 112 that are disposed to mate with C-shaped closures 108, as suggested in FIG. 8 by engagement arrow-headed lines 114, in a pivotal coupling therebetween. Members 106 engage with each other in a similar manner by the engagement of C-shaped closures with rods 112*a*. As a result of this arcuate coupling, bag expander 100 as well as all bag expanders in subsequently described and depicted embodiments can expand or contract between its compressed and expended states as respectively illustrated in FIGS. 1 and 2 and in FIGS. 3 and 4.

Reference is now directed to FIGS. 9-12 depicting a second embodiment, a bag expander 200. Bag expander 200 includes side walls 204 formed generally in parallel. Each wall 204 comprises a frame 205*a* and links 205*b*. The two side walls are coupled together by members 206, depicted as four in number and forming a coupling member assembly 207. Members 206 are articulately joined together into a configuration that has the general shape of a diamond. Such a configuration may be considered as an articulate connection or, if more than one connection, articulate connections, and a joint or joints. In its preferred construction, coupling member assembly 207 is formed as a single moulded article having a pair of end parts 208, all joined by flexible junctions 210 of lesser thickness than its major parts so as to enable segment members 206 and their end parts to flex with respect to one another. The single moulded member is coupled to parallely placed side walls by the end parts to enable the side walls to be collapsed against one another and to be separated away from one another as urged by an expansion motivator. In this embodiment (e.g., see FIG. 10), flexible junctions 210 have somewhat the appearance as axle pins 40 (FIG. 7) (numbered 240 in FIG. 10) in that they terminate in legs 246 and projections 247 so as to accommodate the expansion motivator as represented as rubber band 50 (48).

Figure 9:
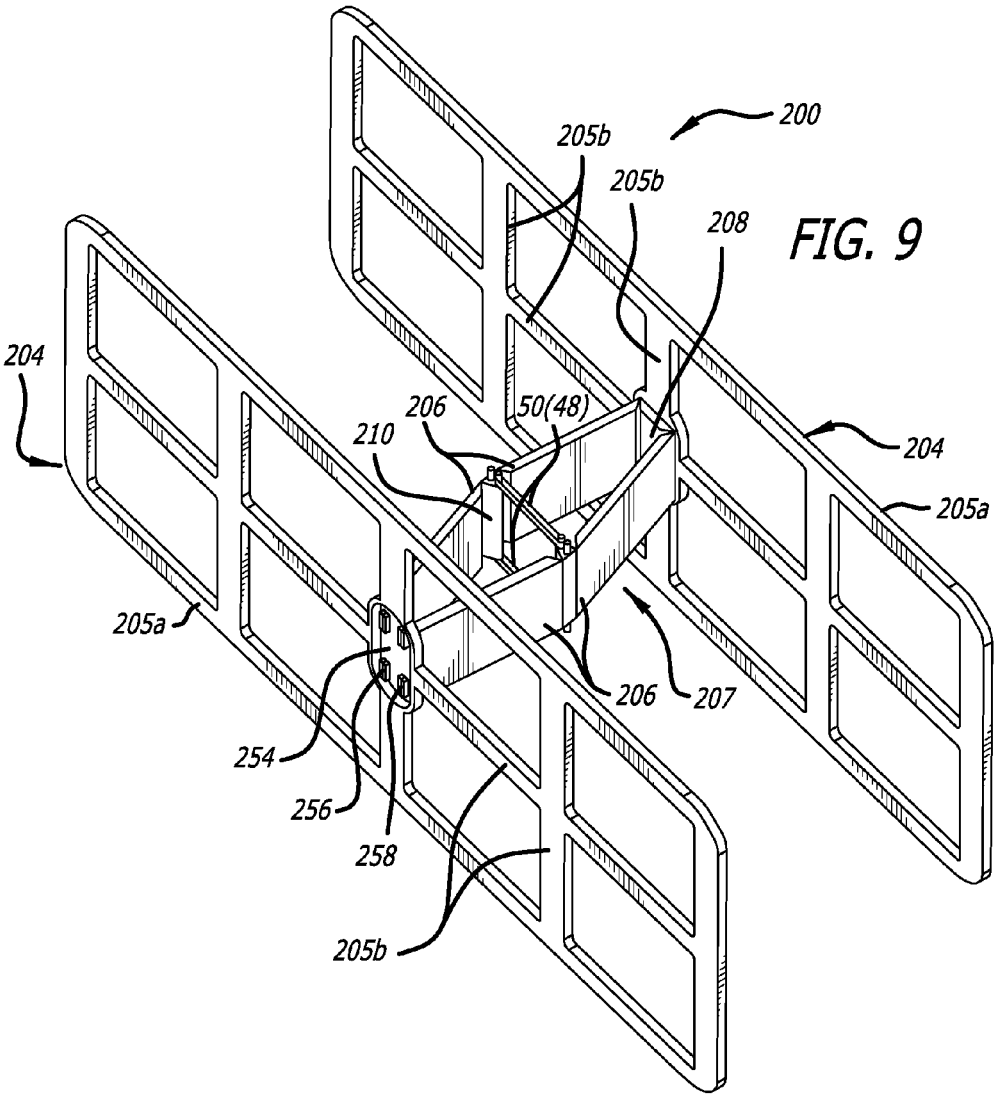
FIG. 9 is an isometric presentation of a second embodiment of the bag expander as expanded when disposed to be contained in a receptacle or bag, is similarly as the first embodiment of FIG. 1 as there depicted in phantom or dashed lines. The bag expander is illustrated as a single moulded member including four segments configured generally as a diamond and a pair of end parts, all joined by flexible junctions that enable the segments and end parts to flex. The single moulded member is coupled to parallely placed side walls by the end parts to enable the side walls to be collapsed against one another and to be separated away from one another as urged by an expansion motivator. The expansion motivator is represented, as an example, as a rubber band. The indicia utilized hereinafter in the second embodiment range within a numerical 200 series.
Figure 10:
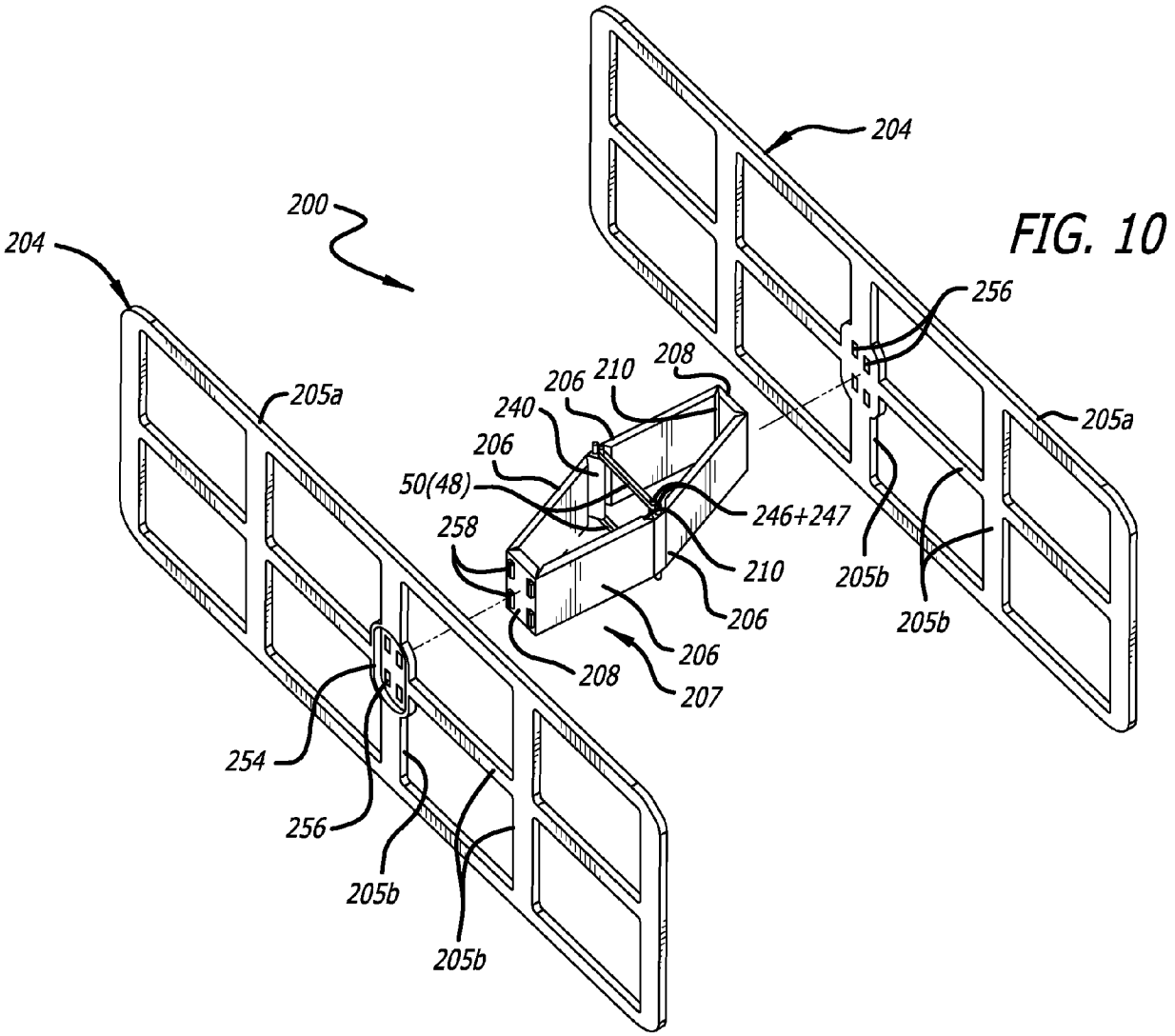
FIG. 10 is an isometric presentation in exploded view of the second embodiment of FIG. 9.
Figure 11:
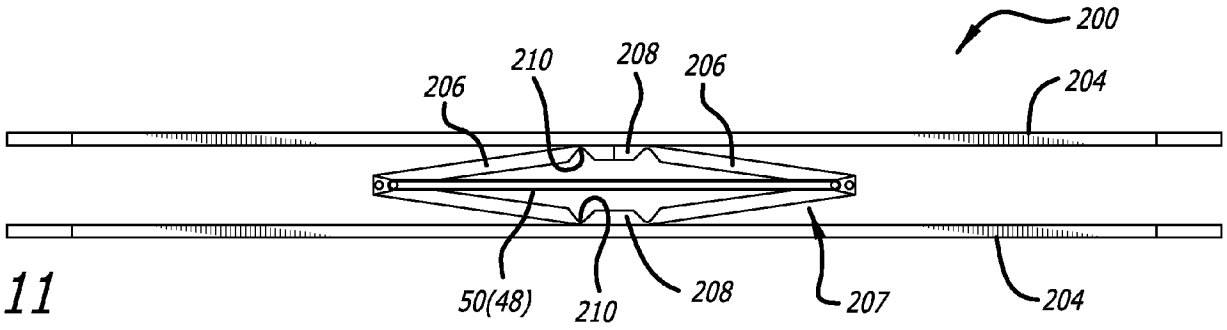
FIG. 11 is a top view of the second embodiment of FIG. 9 as compressed.
Figure 12:
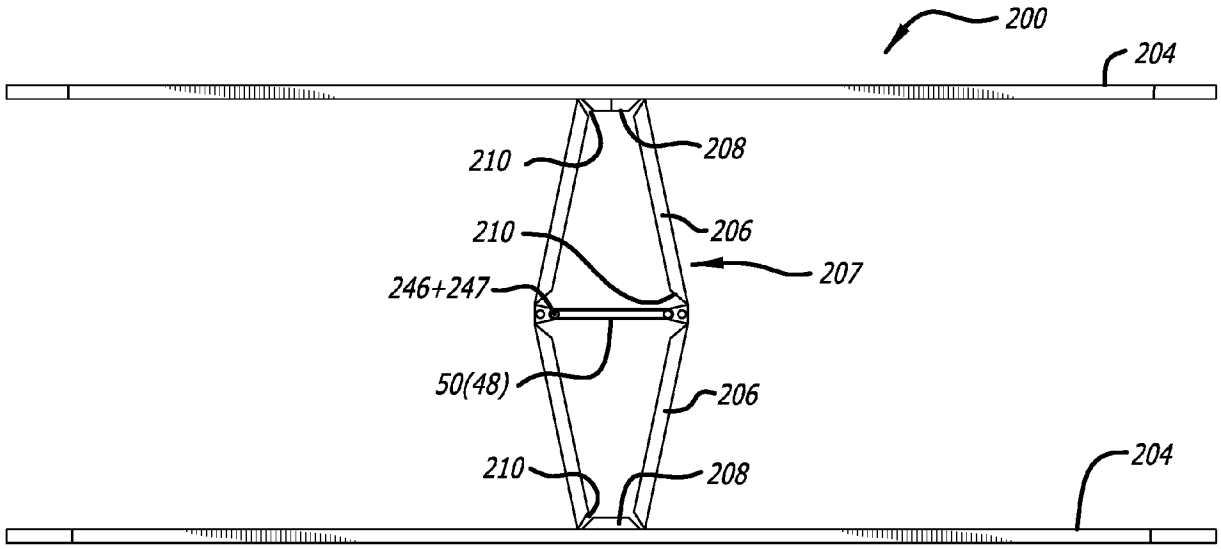
FIG. 12 is a top view of the second embodiment of FIG. 9 as expanded.

As best shown in FIGS. 9 and 10, each opening 254 provides an entry 256 for securing thereto connection points 258 extending from end parts 208.

Figure 13:
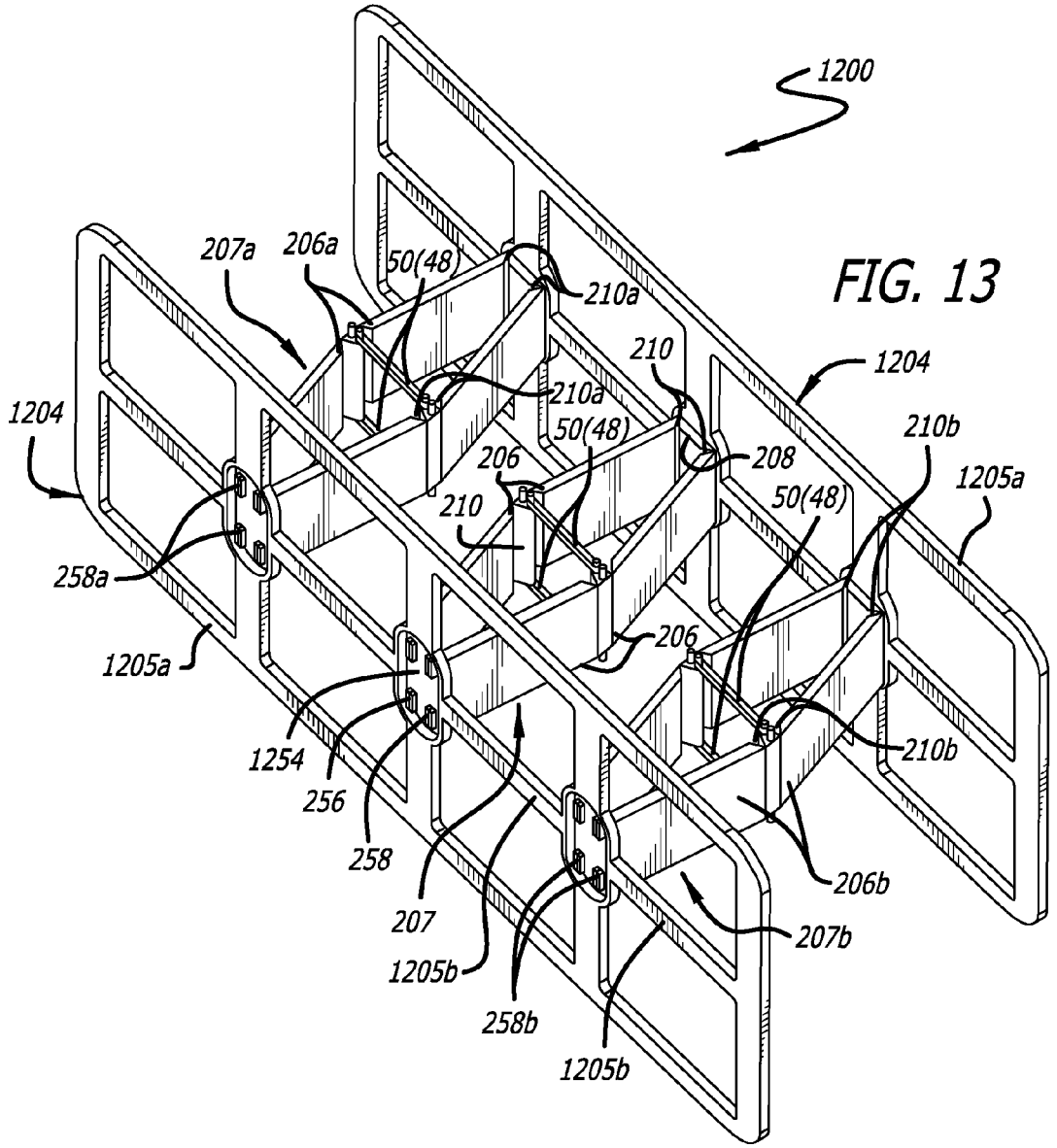
FIG. 13 is an isometric presentation of a third embodiment of bag expander similar to that shown in FIG. 9, but utilizing three parallely placed connecting member assemblies rather than a single connecting member assembly. The indicia utilized hereinafter in the third embodiment range within a numerical 1200 series for those elements of the second embodiment that are modified from the second embodiment in the third embodiment. Inasmuch as each of the three connecting member assemblies of the third embodiment is the same as the single connecting member assembly illustrated in he second embodiment, the indicia utilized with respect therewith add an "a" and a "b" to the second and third connecting member elements and their component parts.
Figure 14:
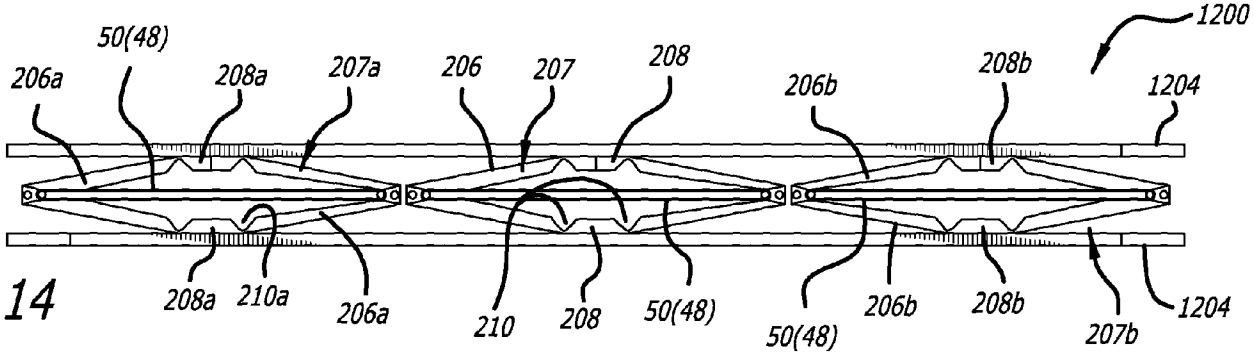
FIG. 14 is a top view of the third embodiment of FIG. 13, as compressed.
Figure 15:
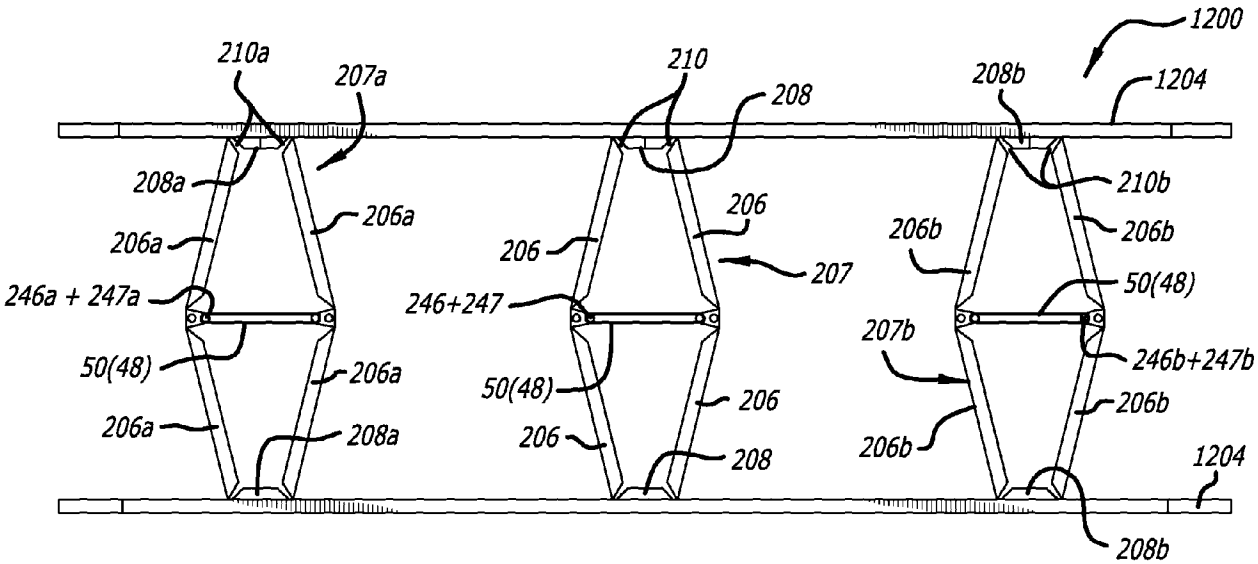
FIG. 15 is a top view of the third embodiment of FIG. 13, as fully expanded.

A third embodiment of the present invention is disclosed in FIGS. 13-15 as a modification of the second embodiment described and depicted in FIGS. 9-12 as adding additional coupling member assemblies thereto. FIGS. 13-15 disclose a bag expander 1200 provided with side walls 1204. Side walls 1204 comprise frames 1205*a* connected by links 1205*b*. Included within links 1205*b* are openings 1254 into which entries 1256 are formed. Where, in FIGS. 9-12 there is a single assembly 207 the third embodiment of FIGS. 13-15 adds two additional connecting member assemblies 207*a* and 207*b*, each comprising connecting members 206*a* and end parts 208*a* and 208*b* joined by flexible junctions 210*a* and 210*b*. This construction utilizing three parallely placed connecting member assemblies 207, 207*a* and 207*b*. The logic supporting this three parallely placed connecting assembly construction is that a bag might be made of a heavy material which would then apply two diamonds to the two end connecting section, which would also stop bowing. In addition, where only connection assembly would be used in the middle, by having three points, additional flexibility is afforded which would not cost more to mold.

Figure 18:
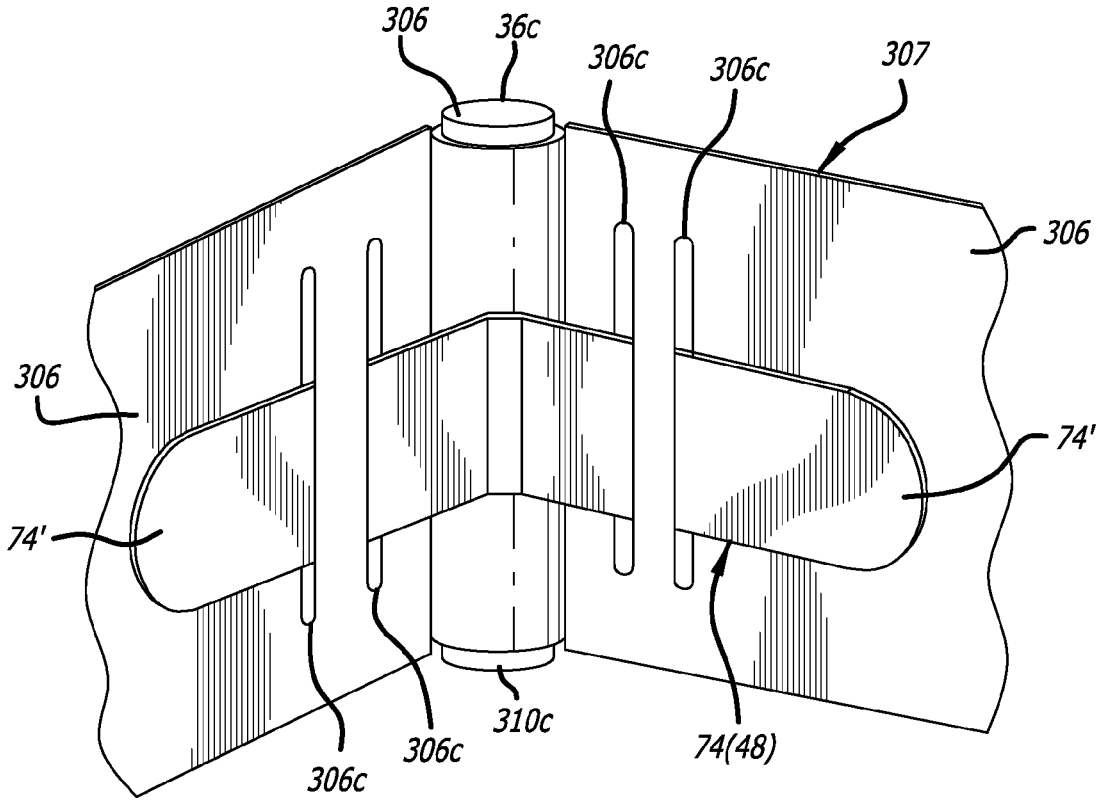
FIG. 18 is an isometric presentation of a third expansion motivator, configured as a leaf spring, useful particularly in the embodiments illustrated in FIGS. 1-9, rather than a rubber band as shown therein.

FIGS. 16-18 depict alternates of generalized expansion motivator 48 as embodied in rubber bands 50, and are easily adaptable to the first embodiment of FIGS. 1-8. FIGS. 16-18 configure the expansion motivator as springs, specifically a single spring 70, a double spring 72 and a leaf spring 74. In FIG. 16, a hinged coupling 310*a* includes alternating pin-enclosure extensions 306*a* extending from members 306 and a pin 36*a* extending through extensions 306*a*. Single spring 70 is centrally mounted about pin 36*a* and urges connecting members 306 to be biased apart through the intermediary of spring terminal extensions 70'. In FIG. 17, a hinged coupling 310*b* includes alternating pin-enclosure extensions 306*b* extending from crossing members 306 and a pin 36*b* extending through extensions 306*b*. Double spring 72 is centrally mounted about pin 36*b* and urges connecting members 306 to be biased apart through the intermediary of spring terminal extensions 72'. In FIG. 16, a hinged coupling 310*c* rotatably couples members 306 together. Slots 306*c* are provided in members 306 through which extensions 74' of leaf spring 74 extend so that leaf spring 74 can urge connecting members 306 to be biased apart.

Figure 19:
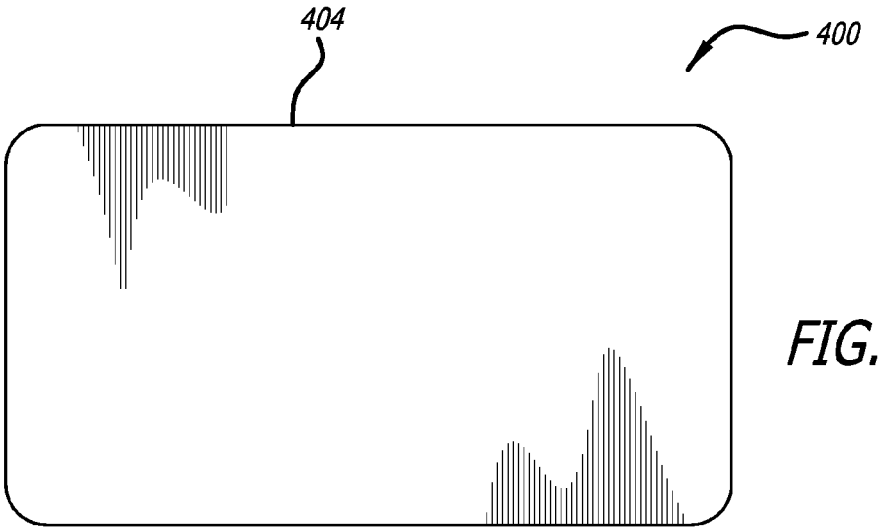
FIG. 19 is an isometric view of a fourth embodiment of the bag expander.
Figure 20:
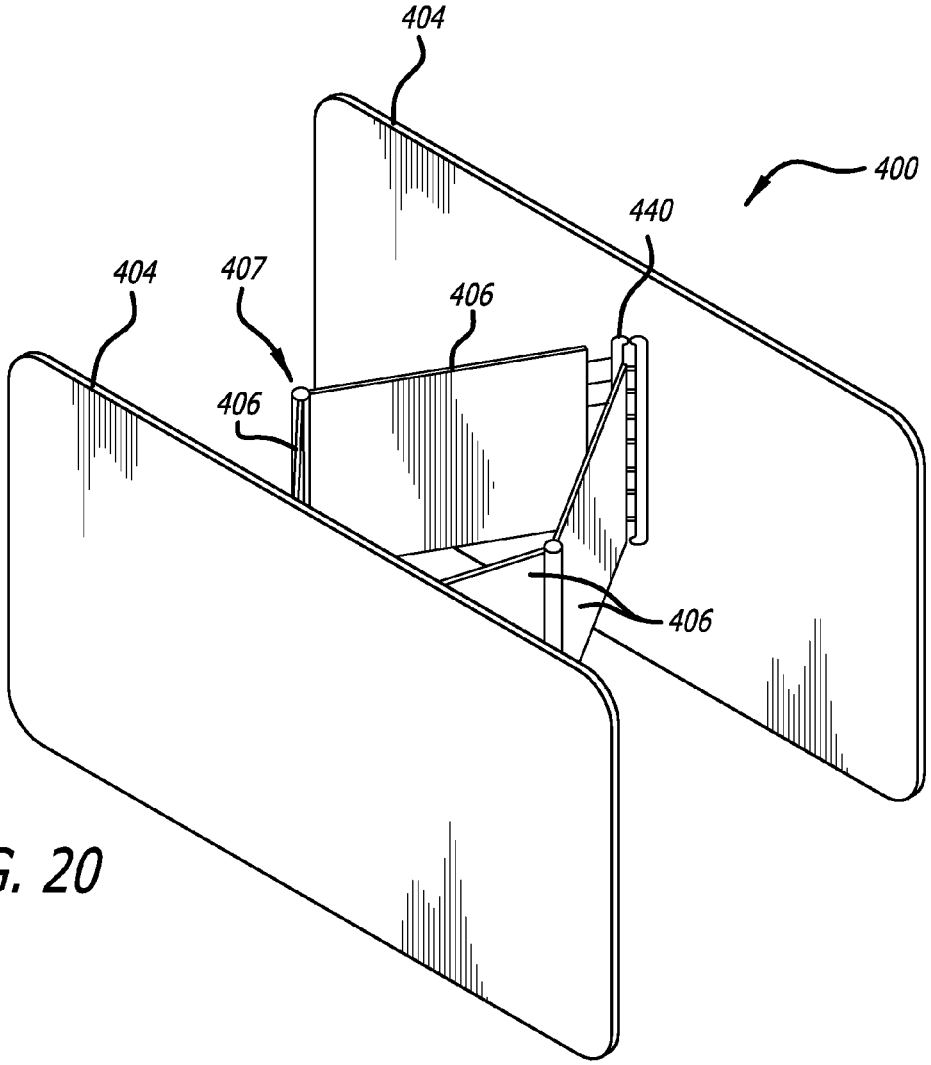
FIG. 20 is a side view of a side wall of the fourth embodiment of the bag expander depicted in FIG. 19.

FIGS. 19 and 29 illustrate a further embodiment of the present invention comprising a bag expander 400 having solid side walls 404 connected by a connecting member assembly 407 formed from connecting members 406. Pivotal connections include axle pins 440 (similar to axle pin 40 as illustrated in FIG. 7) and the like as disclosed in prior embodiments.

Although the invention has been described with respect to particular embodiments thereof, it should be realized that various changes and modifications may be made therein without departing from the spirit and scope of the invention.

What is claimed is:

1. For use with a bag having an interior, a bag expander for enabling its insertion into the bag interior when the bag is in a compressed condition and for enabling its expansion of the bag when the bag is to be positioned into an expanded deployed condition, comprising:

side walls positionable against the bag interior;

members connected together and coupled to said side walls to form articulate connections therebetween;

joints associated with said members and said side walls providing said articulate connections thereamongst thereby enabling the insertion and expansion; and an expansion motivator associated with said members enabling expansion thereof from the bag compressed condition to its expanded condition, wherein said side walls are thus enabled to remain in contact with the bag interior, said members having a folded condition when the bag is in its compressed condition and having an expanded condition when the bag is in its expanded deployed condition, wherein said joints include axle pins which respectively join said members and which said joints are spaced from one another, said axle pins having connecting points, and in which said expansion motivator comprises spring devices coupled to opposed ones of said axle pin connecting points.

2. The bag expander according to claim 1 in which (a) said members, as articulated together, terminate in alternately-directed generally C-shaped closures, (b) each said axle pin comprises a pair of parallely extending legs joined together by a plurality of spaced connecting pieces forming connecting points to which said C-shaped closures are pivotally connected, and (c) said axle pin connecting points are formed at the ends of each of said parallely extending legs for receiving said spring devices and for being biased thereby.

3. The bag expander according to claim 2 wherein said members comprise a plastic material.

4. The bag expander according to claim 1 wherein at least some of said members are coupled together to form a plurality of diamond-shaped configuration parallely placed between said members.

5. The bag expander according to claim 1 wherein said expansion motivator comprises at least one spring member.

6. The bag expander according to claim 5 wherein said spring member comprises coil springs.

7. The bag expander according to claim 5 wherein said spring members comprise rubber bands.

8. The bag expander according to claim 1 wherein said expansion motivator comprises flat springs.

9. For use with a bag having an interior, a bag expander for enabling its insertion into the bag interior when the bag is in a compressed condition and for enabling its expansion of the bag when the bag is to be positioned into an expanded deployed condition, comprising:

side walls positionable against the bag interior;

members connected together and coupled to said side walls to form articulate connections therebetween;

joints associated with said members and said side walls providing said articulate connections thereamongst thereby enabling the insertion and expansion; and an expansion motivator associated with said members enabling expansion thereof from the bag compressed condition to its expanded condition, wherein said side walls are thus enabled to remain in contact with the bag interior, said members having a folded condition when the bag is in its compressed condition and having an expanded condition when the bag is in its expanded deployed condition, in which (a) said articulate connections include axle pins, (b) said members, as articulated together by said articulate connections, terminate in alternately-directed generally C-shaped closures, (c) each said axle pin comprises a pair of parallely extending legs joined together by a plurality of spaced connecting pieces forming connecting points to which said C-shaped closures are pivotally connected, and (d) axle pin connecting points are formed at the ends of each of said parallely parallely extending legs for receiving said spring devices and for being biased thereby.

10. The bag expander according to claim 9 wherein at least some of said members are coupled together to form a diamond-shaped configuration.

11. The bag expander according to claim 10 further including at least second ones of said members formed into a second diamond-shaped configuration which is articulately joined to said at least one of said members and in which said second diamond-shaped configuration (a) is also articulately joined to said side walls in parallel with said first-mentioned diamond-shaped configuration, (b) is similarly constructed as said first-mentioned diamond-shaped configuration and (c) biased by said spring devices.

12. The bag expander according to claim 10 further including at least a second of said members coupled together to form at least one additional diamond-shaped configuration which is serially coupled to said first-mentioned diamond-shaped configuration.

13. For use with a bag having an interior, a bag expander for enabling its insertion into the bag interior when the bag is in a compressed condition and for enabling its expansion of the bag when the bag is to be positioned into an expanded deployed condition, comprising:

side walls positionable against the bag interior;

members connected together and coupled to said side walls to form articulate connections therebetween;

joints associated with said members and said side walls providing said articulate connections thereamongst thereby enabling the insertion and expansion; and an expansion motivator associated with said members enabling expansion thereof from the bag compressed condition to its expanded condition, wherein said side walls are thus enabled to remain in contact with the bag interior, said members having a folded condition when the bag is in its compressed condition and having an expanded condition when the bag is in its expanded deployed condition, wherein:

said expansion motivator comprises at least one spring member and said spring member comprises coil springs, and said members comprise substantially inflexible material; and said joints providing said articulate connections comprise axle pins positioned (a) between mating ones of said members and (b) between mating others of said members and said side walls, and fittings terminating said members and pivotally engaging said axle pins; and said coil springs have centers and ends such that said spring centers are positioned about said axle pins which are positioned between mating ones of said members, and said spring ends are positioned against said mating ones of said members.

14. The bag expander according to claim 13 wherein said axle pins respectively join said members together and to said side walls and which are spaced from one another, said axle pins having connecting points, and in which said expansion motivator comprises spring devices coupled to opposed ones of said axle pin connecting points.

15. For use with a bag having an interior, a bag expander for enabling its insertion into the bag interior when the bag is in a compressed condition and for enabling its expansion of the bag when the bag is to be positioned into an expanded deployed condition, comprising:

side walls positionable against the bag interior;

members connected together and coupled to said side walls to form articulate connections therebetween;

joints associated with said members and said side walls providing said articulate connections thereamongst thereby enabling the insertion and expansion; and an expansion motivator associated with said members enabling expansion thereof from the bag compressed condition to its expanded condition, wherein said side walls are thus enabled to remain in contact with the bag interior, said members having a folded condition when the bag is in its compressed condition and having an expanded condition when the bag is in its expanded deployed condition, wherein:

said expansion motivator comprises flat springs;

said members comprise substantially inflexible material; and said joints providing said articulate connections comprise axle pins positioned (a) between mating ones of said members and (b) between mating others of said members and said side walls, and fittings terminating said members and pivotally engaging said axle pins; and said flat springs have centers and ends such that said spring centers are coupled to said axle pins which are positioned between mating ones of said members, and said spring ends are positioned against said mating ones of said members.

* * * * *